US007591464B2

(12) United States Patent
Mizobe

(10) Patent No.: US 7,591,464 B2
(45) Date of Patent: Sep. 22, 2009

(54) SHEET FEEDING APPARATUS AND IMAGE FORMING APPARATUS

(75) Inventor: Junichiroh Mizobe, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 347 days.

(21) Appl. No.: 11/404,887

(22) Filed: Apr. 17, 2006

(65) Prior Publication Data

US 2006/0237898 A1 Oct. 26, 2006

(30) Foreign Application Priority Data

Apr. 26, 2005 (JP) ..... 2005-128408

(51) Int. Cl.
*B65H 1/10* (2006.01)
*B65H 1/12* (2006.01)

(52) U.S. Cl. ..... 271/160; 271/145; 271/162; 271/147

(58) Field of Classification Search ..... 271/145, 271/162, 147, 160
See application file for complete search history.

(56) References Cited

U.S. PATENT DOCUMENTS 4,494,746 A * 1/1985 Moser ..... 271/164
4,526,358 A * 7/1985 Ura et al. ..... 271/34
5,044,620 A * 9/1991 Ruch et al. ..... 271/9.08
5,075,721 A * 12/1991 Paulsel et al. ..... 355/72
5,364,088 A * 11/1994 Maruyama et al. ..... 271/164
5,386,982 A * 2/1995 Kawano ..... 271/10.04
5,419,544 A * 5/1995 Ono et al. ..... 271/164
5,568,166 A * 10/1996 Yamazaki ..... 346/134
5,605,323 A * 2/1997 Wirth et al. ..... 271/145
5,860,647 A * 1/1999 Ikesue ..... 271/213
5,927,707 A * 7/1999 Miura ..... 271/171
5,938,188 A * 8/1999 Nagahara ..... 271/121
7,165,766 B2 * 1/2007 Sato ..... 271/145
7,334,786 B2 * 2/2008 Shinga ..... 271/9.11
7,334,789 B2 * 2/2008 Herrmann et al. ..... 271/145
7,469,892 B2 * 12/2008 Iwase et al. ..... 271/164
2004/0041334 A1 * 3/2004 Yoshihara ..... 271/145
2005/0151315 A1 * 7/2005 Yokoi ..... 271/145

FOREIGN PATENT DOCUMENTS

JP 2002-226065 8/2002
JP 2004-117395 4/2004

* cited by examiner

*Primary Examiner*—Patrick H Mackey
*Assistant Examiner*—Prasad V Gokhale
(74) *Attorney, Agent, or Firm*—Fitzpatrick, Cella, Harper & Scinto

(57) ABSTRACT

A sheet feeding apparatus has a cassette retracting mechanism which retracts a sheet supplying cassette to a mounting position when the sheet supplying cassette is to be mounted on an apparatus main body, and protrudes the sheet supplying cassette from the apparatus main body when the sheet supplying cassette is to be detached, and which, when the sheet supplying cassette is to be mounted on the apparatus main body, brings a separating member provided on the sheet supplying cassette into contact with a sheet feeding roller provided in the apparatus main body immediately after the cassette retracting mechanism has generated a maximum retracting force, and when the sheet supplying cassette is to be detached, generates a maximum pushing-out force immediately after the separating member has been spaced apart from the sheet feeding roller, to thereby protrude the sheet supplying cassette from the apparatus main body.

12 Claims, 9 Drawing Sheets

SHEET FEEDING APPARATUS AND IMAGE FORMING APPARATUS

BACKGROUND OF THE INVENTION

1. Field of the Invention

The invention relates to a sheet feeding apparatus and an image forming apparatus, and particularly to a sheet feeding apparatus and an image forming apparatus having the retracting function of retracting a sheet containing member.

2. Description of the Related Art

Heretofore, in an image forming apparatus provided with a sheet feeding apparatus having a sheet containing member such as a sheet supplying cassette, sheets stacked on the sheet supplying cassette set at a predetermined mounting position in an apparatus main body have been successively supplied to an image forming portion, and image formation on the sheets has been effected in the image forming portion.

Now, the sheet supplying cassette which is the sheet containing member is detachably mounted with respect to the apparatus main body by a user's manual work for the purpose of filling up the container with sheets or changing the sheet size. At this time, there is a case where the sheet supplying cassette filled up with the sheets is not sufficiently pushed into the mounting position in the apparatus main body. In such a case, the sheet supplying cassette has not been positioned and as the result, an image has not been accurately formed on a sheet or the faulty conveyance of the sheet has occurred.

Also, particularly in a sheet feeding apparatus corresponding to A3 and LDR, the weight of the sheet feeding cassette plus the weight of sheets becomes 2N or greater, and the operability when the sheet supplying cassette is inserted into the mounting position becomes bad. So, heretofore, as described in Japanese Patent Application Laid-open No. 2004-117395, in order to improve the operability, there has been proposed a sheet feeding apparatus provided, for example, with a retracting device of a construction in which from this side of a regular mounting position in the sheet supplying cassette, the sheet supplying cassette is adapted to be forcibly retracted to the mounting position by the use of driving means such as a motor.

Also, as another retracting device, there is one in which a projected portion is provided on a sheet supplying cassette and also, a spring-biased rotary member is provided on an apparatus main body side, and when the projected portion gets over the rotary member, the rotary member is adapted to bias the projected portion by the resilient force of the spring. In this retracting device, as described in Japanese Patent Application Laid-open No. 2002-226065, design is made such that the sheet supplying cassette is biased through the projected portion, whereby the sheet supplying cassette is forcibly retracted from this side of the mounting position to the mounting position.

In such a conventional sheet feeding apparatus and a conventional image forming apparatus, however, in the case of a construction in which for example, the sheet feeding cassette is forcibly retracted to the mounting position by the use of driving means such as a motor, there is the problem that the construction becomes complicated and the apparatus becomes bulky and the cost also becomes high. Also, in the construction wherein the sheet supplying cassette is retracted by the spring-biased rotary member, there does not arise such a problem of the bulkiness and high cost of the apparatus. However, when the sheet supplying cassette is to be mounted, a separating member provided on the sheet supplying cassette for separating the sheets and a sheet feeding member provided in the apparatus main body frictionally contact with each other to provide the load of mounting or positioning resistance. Further, in a case where detecting means for detecting sheet sizes is provided on this side of the mounting position for the sheet supplying cassette, there is a load for the sheet size detection by this detecting means, and to overcome this load and perform the retracting operation, it is necessary to make the retracting force greater. That is, to reliably retract the sheet supplying cassette to the mounting position, it is necessary to use a spring of a great spring force. However, if use is made of such a spring of a great spring force, when the sheet supplying cassette is to be taken out of the apparatus main body, the cassette must be drawn out against the great spring force, and a great operating force becomes necessary, and this leads to the problem that operability is aggravated.

SUMMARY OF THE INVENTION

So, the present invention has been made in view of such circumstances and has as its object to provide a sheet feeding apparatus and an image forming apparatus which enables a sheet containing member to be retracted and taken out by a simple construction and without requiring a great operating force.

The sheet feeding apparatus of the present invention is provided with a sheet containing member detachably mounted on an apparatus main body, a sheet feeding member provided in the apparatus main body configure to feed out sheets stacked on the sheet containing member, a separating member configure to contact with the sheet feeding member and separating the sheets one by one, and a retracting device provided in the apparatus main body configure to be engaged with the sheet containing member in the course of the sheet containing member being mounted on the apparatus main body, to thereby generate a retracting force for retracting the sheet containing member to a mounting position for feeding the sheets contained therein, and when the sheet containing member is to be mounted on the apparatus main body, the separating member provided in the sheet containing member is adapted to contact with the sheet feeding member provided in the apparatus main body immediately after the retracting device has generated a maximum retracting force.

DESCRIPTION OF THE PREFERRED EMBODIMENTS

Some preferred embodiments for carrying out the present invention will hereinafter be described in detail with reference to the drawings.

Figure 1:
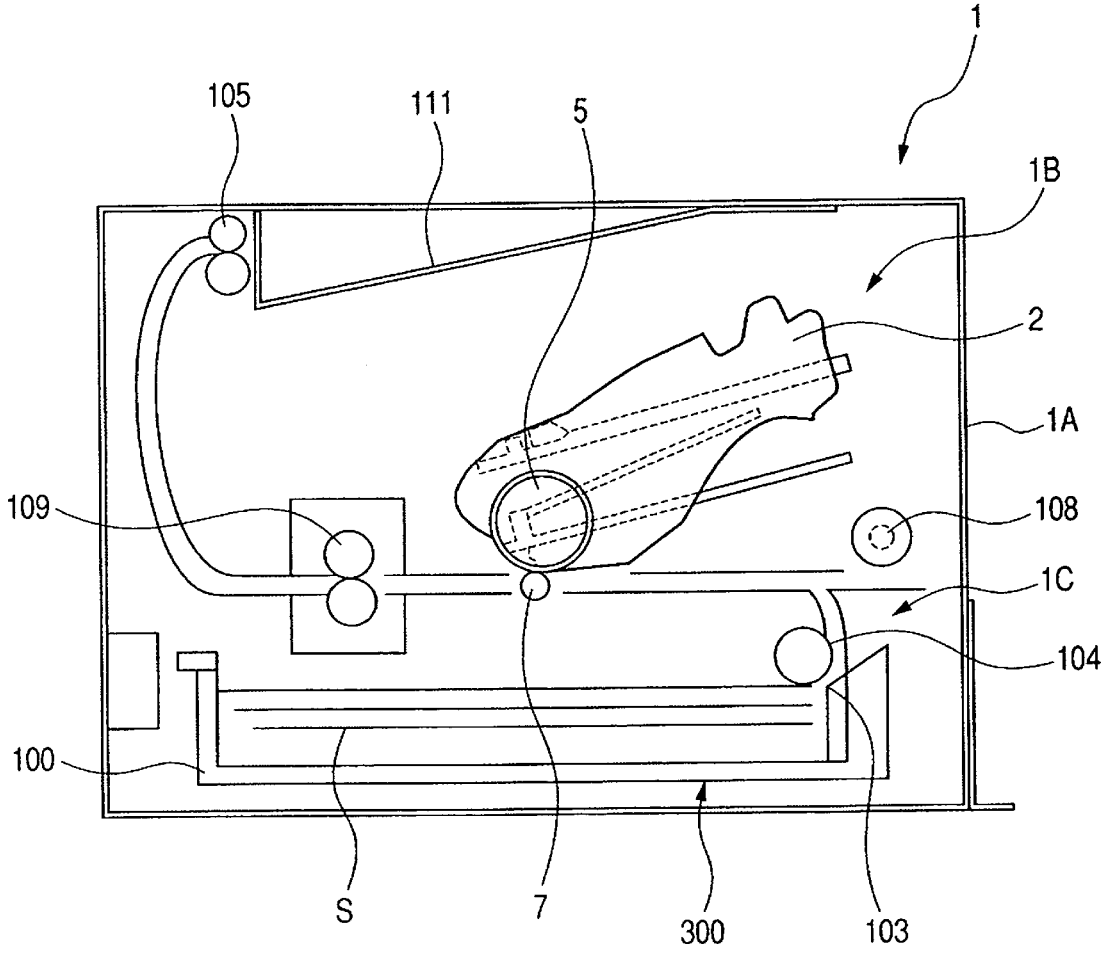
FIG. 1 schematically shows the construction of an image forming apparatus provided with a sheet feeding apparatus according to a first embodiment of the present invention.

FIG. 1 schematically shows the construction of an image forming apparatus provided with a sheet feeding apparatus according to a first embodiment of the present invention.

In FIG. 1, the image forming apparatus 1 has an image forming apparatus main body (hereinafter referred to as the apparatus main body) 1A. The apparatus main body 1A is provided with an image forming portion 1B for effecting image formation by an electrophotographic printing method. The sheet feeding apparatus 1C feeds a sheet S to the image forming portion 1B.

This image forming portion 1B is provided with a photosensitive drum 5 on which a toner image is formed, a transfer roller 7 for transferring the toner image formed on the photosensitive drum 5 to the sheet S, etc. A process cartridge 2 is provided with the photosensitive drum 5, a developing device (not shown), a charging roller, etc.

When an image forming operation is started in the image forming portion 1B of such a construction, light according to an image signal is first applied to the photosensitive drum 5 having had its surface charged and rotatively driven by driving means (not shown), by a laser scanner (not shown). By such light according to the image signal being applied to the photosensitive drum 5, a latent image is formed on the photosensitive drum 5. Next, this latent image is developed with a toner, whereby a toner image (visible image) is formed on the photosensitive drum 5.

Also, the sheet feeding apparatus 1C is provided with a sheet supplying cassette 100 which is a sheet containing member. It is further provided with a sheet feeding roller 104 which is a sheet feeding member provided above the sheet supplying cassette 100 for feeding the sheets S contained in the sheet supplying cassette 100, and a separating pad 103 as a separating member for separating the sheets S fed out by the sheet feeding roller 104.

A manually sheet feeding portion for manually feeding the sheets is contained in a side of the apparatus main body 1A, and in case of manual sheet feeding, this manually sheet feeding portion is drawn out and also, the sheet S is fed by a manual tray sheet feeding roller 108.

In such a sheet feeding apparatus 1C, in parallel with the toner image forming operation as described above, the sheets S are fed out from the sheet supplying cassette 100 by the sheet feeding roller 104, whereafter the sheets are separated one by one by the separating pad 103. Or the sheets S are fed out from the manually sheet feeding portion.

Then, the sheet S thus fed out from the sheet supplying cassette 100 or the manually sheet feeding portion is conveyed to a transferring portion constituted by the photosensitive drum 5 and the transfer roller 7 at predetermined timing. Then, in this transferring portion, a bias is applied to the transfer roller 7, whereby the toner image is transferred to the sheet S.

Thereafter, the sheet S to which the toner image has been transferred in this manner is conveyed to fixing means 109, where the sheet S is pressurized and heated, whereby the toner image thereon is fixed, whereafter the sheet is discharged to a discharge portion 111 in the upper portion of the apparatus by discharge rollers 105.

Now, the sheet supplying cassette 100 as the sheet containing member is horizontally disposed in the apparatus main body 1A, in other words, a sheet feeding apparatus main body (not shown). In the present embodiment, it is detachably mountable in the direction indicated by the arrow in FIG. 2 orthogonal to a sheet feeding direction in which the stacked sheets S are fed out. Also, this sheet supplying cassette 100 is provided with an intermediate plate (not shown) so that by the use of a spring, the sheets stacked on the intermediate plate may be urged against the sheet feeding roller 104 to thereby obtain sheet feeding pressure.

Figure 2:
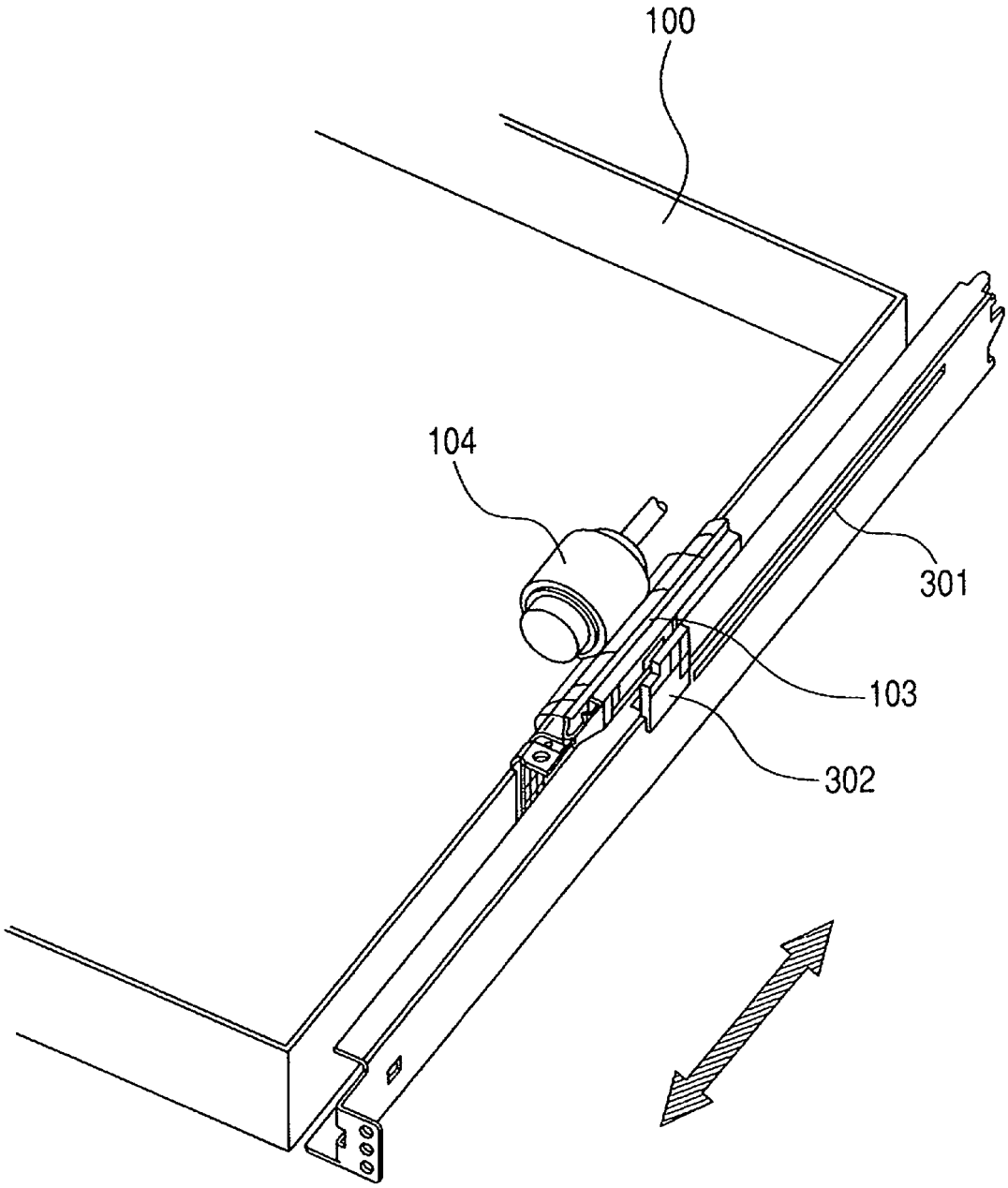
FIG. 2 is a perspective view illustrating the construction of a sheet supplying cassette detachably mounted on the sheet feeding apparatus.

Further, the separating pad 103 constituting a separating portion together with the sheet feeding roller 104 is held on the sheet supplying cassette 100 for movement toward and away from the sheet feeding roller 104. In FIG. 2, the reference numeral 301 designates a rail member provided in the apparatus main body 1A for guiding the sheet supplying cassette 100. On this side of the mounting position (regular mounting position) of this rail member 301 which is the final retracted position of the sheet supplying cassette 100 with respect to the mounting direction, where is provided a cam 302 for the separating pad as the moving member of the present invention for pushing up the separating pad 103.

When the sheet supplying cassette 100 is to be mounted by means of this cam 302 for the separating pad, when the sheet supplying cassette 100 is pushed into the apparatus main body 1A along the rail member 301, the separating pad 103 is pushed up on this side of the mounting position of the sheet supplying cassette 100. Thereby, the separating pad 103 comes into contact with the sheet feeding roller 104. When the sheet supplying cassette 100 is to be drawn out, the cam 302 for the separating pad separates from the separating pad 103 while the cassette 100 is being drawn out, and the separating pad 103 is spaced apart from the sheet feeding roller 104 by a spring (not shown).

As described above, during the mounting of the sheet supplying cassette 100, the separating pad 103 is brought into contact with the sheet feeding roller 104 on this side of the mounting position, whereby the sheet feeding roller 104 and the separating pad 103 can be prevented from contacting with each other when the sheet supplying cassette 100 is inserted. Thereby, the sliding resistance when the sheet supplying cassette 100 is inserted can be suppressed. Also, the contact timing between the sheet feeding roller 104 and the separating pad 103 is adjustable and therefore, design for making the contact amount between the sheet feeding roller 104 and the separating pad 103 small becomes possible.

On the other hand, the sheet feeding apparatus 1C is provided with a cassette retracting mechanism which is a retracting device for retracting the sheet supplying cassette 100 to the mounting position in the apparatus main body.

Figure 3:
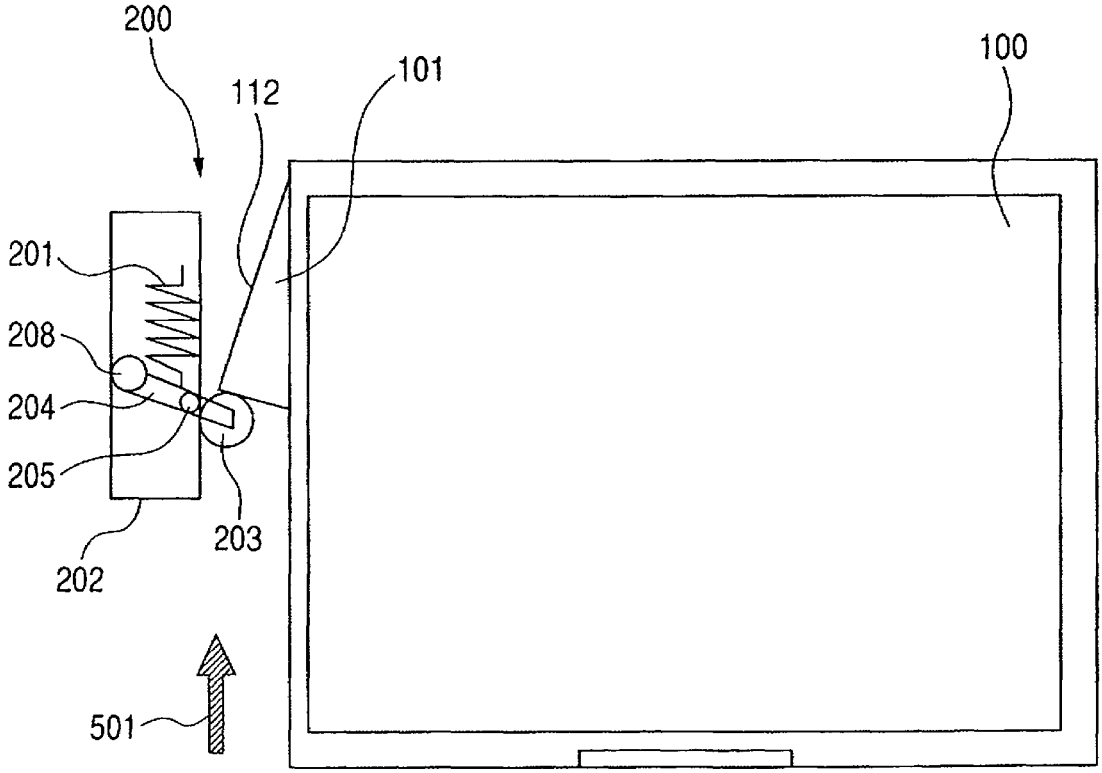
FIG. 3 illustrates the construction of a sheet supplying cassette retracting mechanism provided in the sheet feeding apparatus.

FIG. 3 illustrates such a cassette retracting mechanism. In FIG. 3, the reference numeral 200 denotes the cassette retracting mechanism. This cassette retracting mechanism 200 is provided with a base 202 mounted on the apparatus main body 1A, an arm 204 as a pivot member pivotally mounted on the base 202 with a pivot shaft 208 as a fulcrum, and a cam 101 mounted on the sheet supplying cassette 100. It is further provided with a resilient member 201 for biasing the arm 204 into pressure contact with the cam 101.

In FIG. 3, the other end of the resilient member 201 such as a coil spring having one end thereof restrained on the base 202 is restrained on a shaft 205 provided on the arm 204. This arm 204 contacts with a rigid member (not shown) and stands by at a predetermined point when the sheet supplying cassette 100 is outside the apparatus main body. Also, the arm 204 is adapted to be pivotally movable along the cam 101 with small sliding resistance by a runner 203 journalled to the pivot end of the arm 204.

Figure 4:
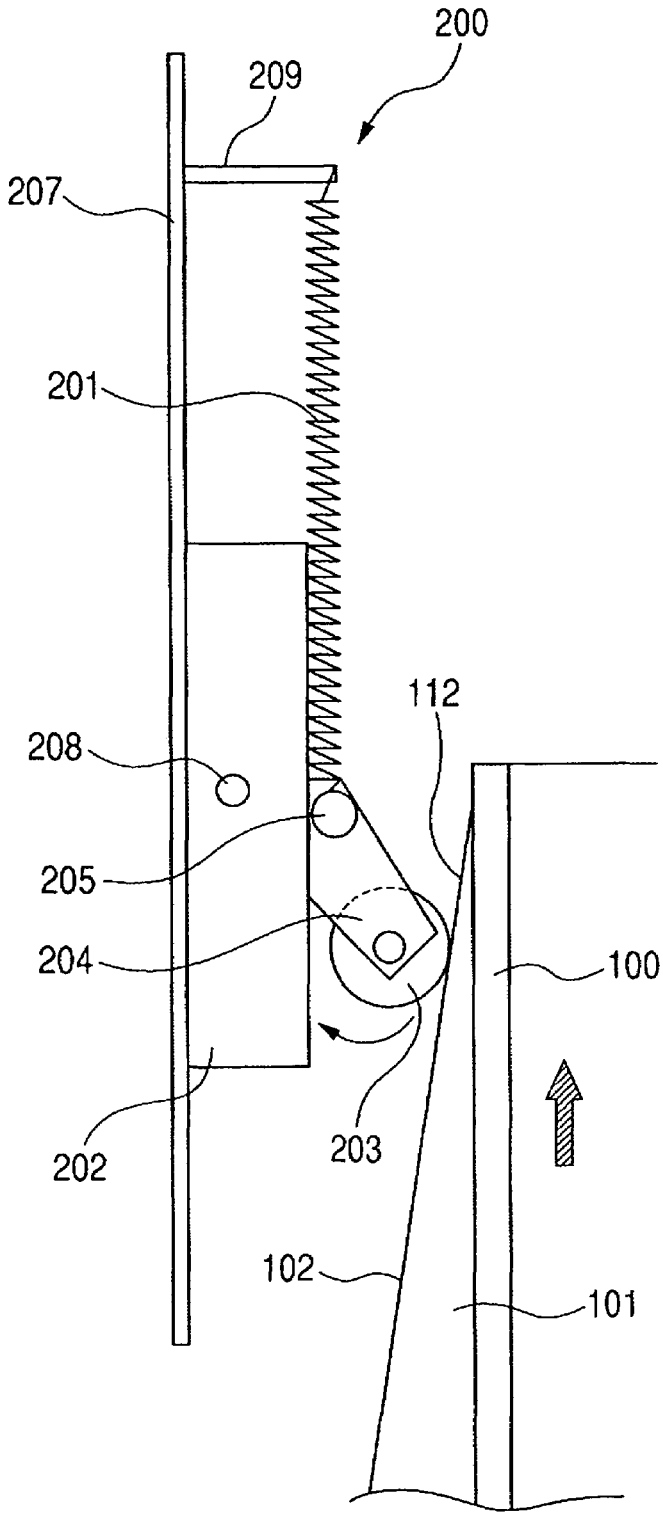
FIG. 4 is a first view illustrating the sheet supplying cassette retracting operation of the sheet supplying cassette retracting mechanism.

In the cassette retracting mechanism 200 of such a construction, when the sheet supplying cassette 100 is inserted, the runner 203 biased by the resilient member 201 is first urged against the cam distal end portion 112 of the cam 101 mounted on the sheet supplying cassette 100, as shown in FIG. 4. Thereby, the runner 203 is rotated while frictionally contacting with the cam.

Also, at this time, the arm 204 is clockwisely pivotally moved in accordance with the shape of the cam 101 while pressing the cam 101 by the resilient member 201 with the runner 203 interposed therebetween. By the cam 101 being thus pivotally moved, the resilient member 201 which is a force accumulating member gradually comes to accumulate a retracting force therein.

Figure 5:
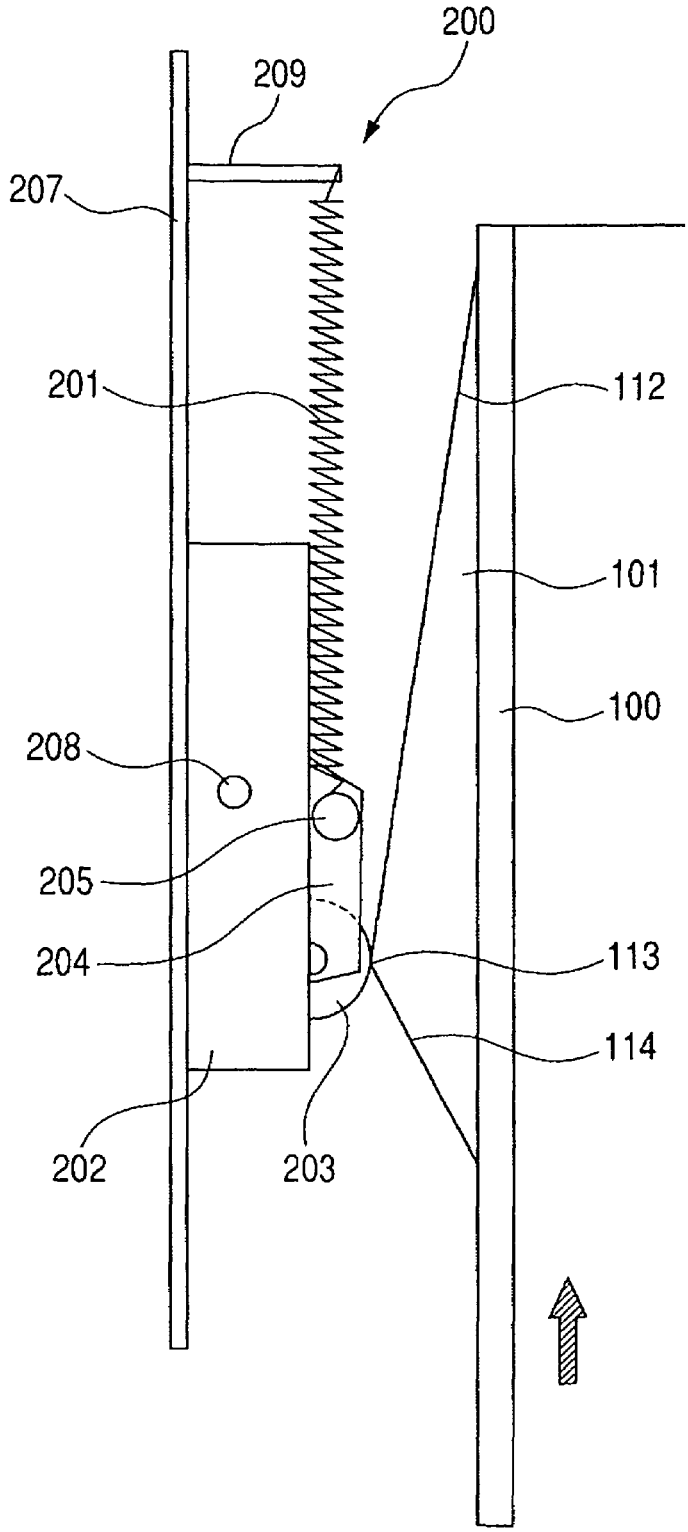
FIG. 5 is a second view illustrating the sheet supplying cassette retracting operation of the sheet supplying cassette retracting mechanism.
Figure 6:
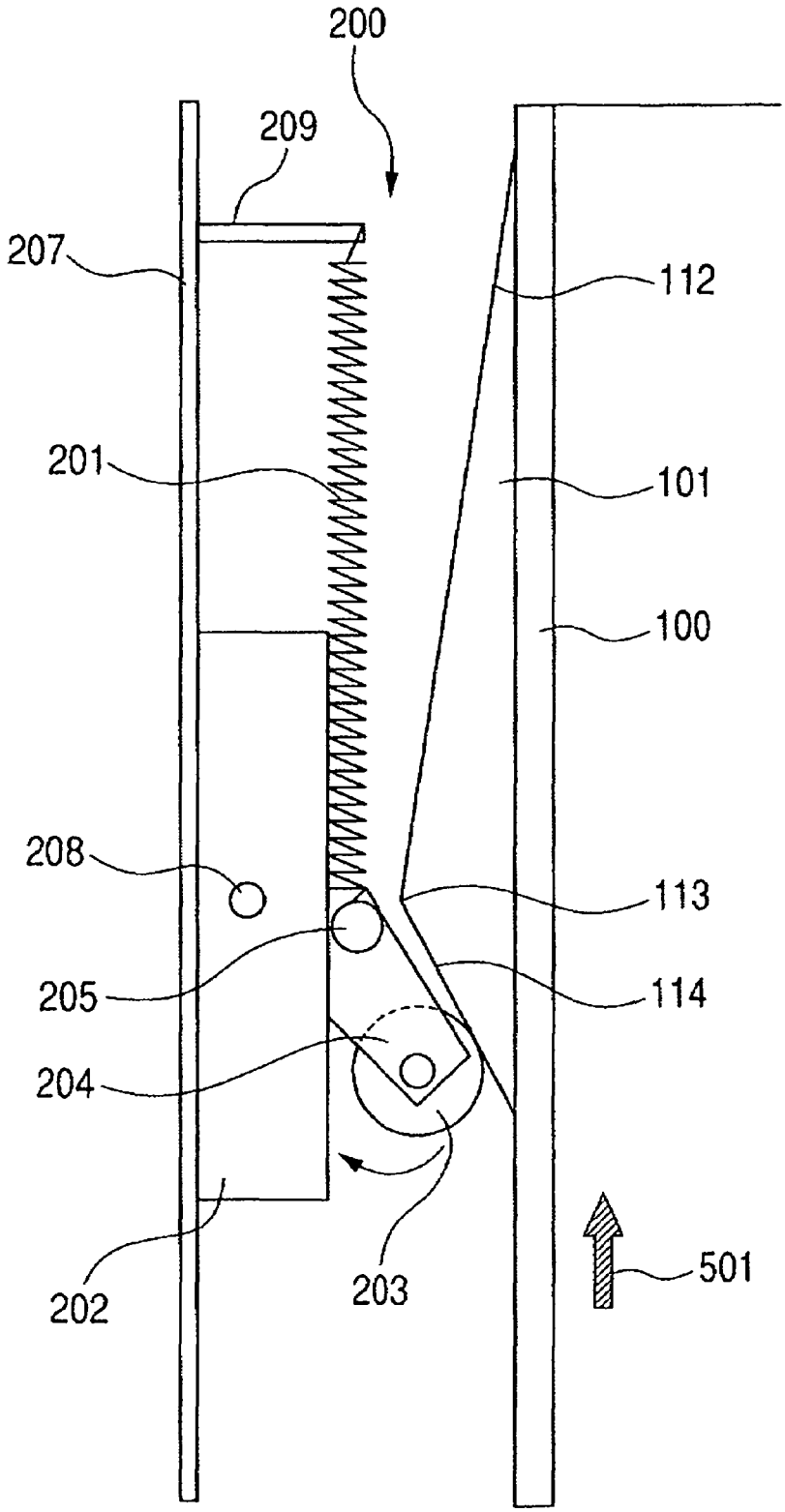
FIG. 6 is a third view illustrating the sheet supplying cassette retracting operation of the sheet supplying cassette retracting mechanism.

Thereafter, the cam 101 and the runner 203 keep their contact state and soon, as shown in FIG. 5, the runner 203 arrives at the vertex 113 of the cam 101. Thereafter, as shown in FIG. 6, the runner 203 passes the vertex 113 of the cam 101, whereupon the runner 203 comes into pressure contact with the rear end portion 114 of the cam 101. As the result, the sheet supplying cassette 100 is pressed in the direction indicated by the arrow 501 which is a direction in which it is retracted to the mounting position in the apparatus main body 1A, by the runner 203 through the cam 101. Thus, the sheet supplying cassette 100 is retracted to the mounting position.

In the present embodiment, design is made such that in the state immediately after the runner 203 has thus passed the vertex 113 of the cam 101, the resilient member 201 which has so far gradually accumulated the retracting force therein with the movement of the sheet supplying cassette 100 can generate maximum retracting pressure 16N.

Also, there is adopted a construction in which this force is utilized to retract the sheet supplying cassette 100. Also, 15 mm is secured as the retraction stroke amount at this time. This retraction stroke amount is the retraction distance (amount) of the sheet supplying cassette 100 by the cassette retracting mechanism 200.

In the sheet feeding apparatus 1C wherein the sheet supplying cassette 100 is mounted and dismounted in the direction (the direction indicated by the arrow in FIG. 2) orthogonal to the sheet feeding direction, there occurs sliding resistance when the cassette 100 is pushed into the mounting position after the already described sheet feeding roller 104 and separating pad 103 have contacted with each other. Further, besides this sliding resistance, a lot of resistance such as the positioning resistance of the sheet supplying cassette 100 and the pressure resistance of a sensor switch for detecting the sheet size occurs in the vicinity of 15-10 mm this side from the mounting position of the sheet supplying cassette 100.

Therefore, in the present embodiment, design is made such that the sheet feeding roller 104 and the separating pad 103 contact with each other immediately after the cassette retracting mechanism 200 has generated the maximum retracting pressure in the vicinity of 15 mm this side from the mounting position of the sheet supplying cassette 100. By the maximum retracting pressure being thus generated in the vicinity of 15 mm by the cassette retracting mechanism 200, the sheet supplying cassette 100 can be completely retracted to the mounting position. Thereby, the supply of the sheets S and the usability during the changing of the sheet size can be improved greatly.

As described above, when the sheet supplying cassette 100 is to be mounted, the sheet supplying cassette 100 is brought into engagement with the cassette retracting mechanism 200 on this side of the mounting position so as to retract the sheet supplying cassette 100 to the mounting position. Further, immediately after the maximum retracting force has been generated in the course of insertion, the separating pad 103 is brought into contact with the sheet feeding roller 104 so as to retract the sheet supplying cassette 100 to the mounting position.

Thus, it becomes possible to reliably retract the sheet supplying cassette 100 to the mounting position by a simple construction and without requiring a great operating force, and the usability is improved.

On the other hand, when the sheet supplying cassette 100 is to be taken out, when the sheet supplying cassette 100 is drawn out in a direction opposite to the direction indicated by the arrow 501 in FIG. 6, the runner 203 first comes into pressure contact with the rear end portion 114 of the cam 101. Thereafter, the sheet supplying cassette 100 is further drawn out, whereby the runner 203 arrives at the vertex 113 of the cam 101, as shown in FIG. 5. It is immediately after the separating pad 103 has been spaced apart from the sheet feeding roller 104 that the runner 203 thus arrives at the vertex 113 of the cam 101.

At this time, the pushing-out force so far gradually accumulated in the resilient member 201 with the movement of the sheet supplying cassette 100 becomes maximum. When thereafter, the runner 203 passes the vertex 113 of the cam 101, this pushing-out force is liberated, and by this liberation of the pushing-out force, a force in a direction to push out the sheet supplying cassette 100 from the apparatus main body 1A acts on the sheet supplying cassette 100.

As described above, when the sheet supplying cassette 100 is to be taken out, the sheet supplying cassette 100 is protruded by the cassette retracting mechanism 200. Further, immediately after in the course of drawing-out, the separating pad 103 has been spaced apart from the sheet feeding roller 104, a maximum pushing-out force is generated so as to protrude the sheet supplying cassette 100 from the apparatus main body 1A. Thus, it becomes possible to take out the sheet supplying cassette 100 by a simple construction and without requiring a great operating force, whereby the usability is improved.

As described above, during the mounting of the sheet supplying cassette, the sheet supplying cassette 100 is adapted to be retracted immediately before the separating pad 103 contacts with the sheet feeding roller 104, whereby the sheet supplying cassette 100 can be retracted by a simple construction and without requiring a great operating force. Also, when the sheet supplying cassette 100 is to be detached, the sheet supplying cassette 100 is adapted to be protruded immediately after the separating pad 103 has been spaced apart from the sheet feeding roller 104, whereby it is possible to take out the sheet supplying cassette 100 by a simple construction and without requiring a great operating force.

In the present embodiment, as already described, the separating pad 103 is brought into contact with the sheet feeding roller 104 on this side of the mounting position of the sheet supplying cassette 100, whereby the sliding resistance when the sheet supplying cassette 100 is inserted can be suppressed. Thereby, the resilient force of the resilient member 201 of the cassette retracting mechanism 200 can be made smaller.

By the resilient force of the resilient member 201 being thus made smaller, a force necessary when a user inserts and draws out the sheet supplying cassette 100 becomes smaller and therefore, the supply of the sheets S and the usability during the changing of the sheet size can be improved greatly.

Also in a case where for example, during the sheet feeding operation, the sheet feeding apparatus 1C is stopped and the sheet S is residual between the sheet feeding roller 104 and the separating pad 103, when the sheet supplying cassette 100 is drawn out, the separating pad 103 is spaced apart from the sheet feeding roller 104 and therefore the contacting force is released. Thereby, the mitigation of damage to the sheet S becomes possible.

Description will now be made of a second embodiment of the present invention.

Figure 7:
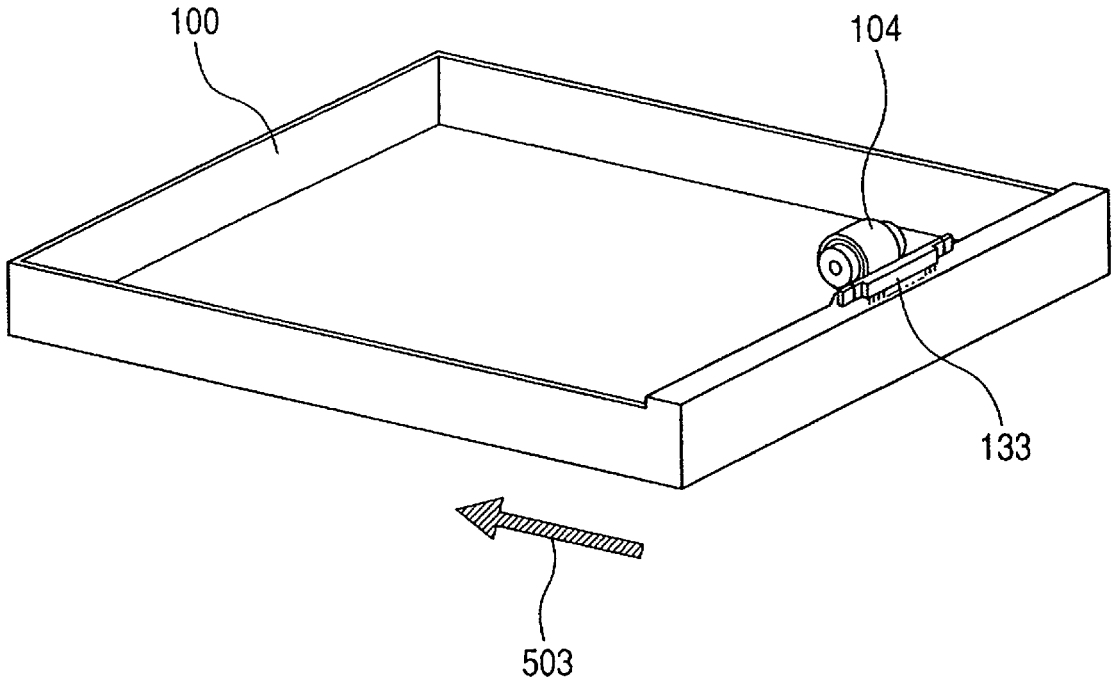
FIG. 7 is a perspective view of the sheet supplying cassette of a sheet feeding apparatus according to a second embodiment of the present invention.

FIG. 7 is a perspective view of the sheet supplying cassette 100 of a sheet feeding apparatus 1C according to the present embodiment. This sheet supplying cassette 100 is provided with a separating pad 133, and is adapted to be mounted on the apparatus main body 1A from a direction opposite to the sheet feeding direction. That is, in the present embodiment, the sheet supplying cassette 100 is adapted to be inserted from the right to the left as indicated by the arrow 503, and on this side of the mounting position, the separating pad 133 is adapted to contact with the sheet feeding roller 104.

As described above, during the insertion of the sheet supplying cassette, on this side of the mounting position, the separating pad 133 is brought into contact with the sheet feeding roller 104 to thereby prevent the sheet feeding roller 104 and the separating pad 133 from contacting with each other during the insertion of the sheet supplying cassette. Thereby, the sliding resistance when the sheet supplying cassette 100 is inserted can be suppressed.

Figure 8:
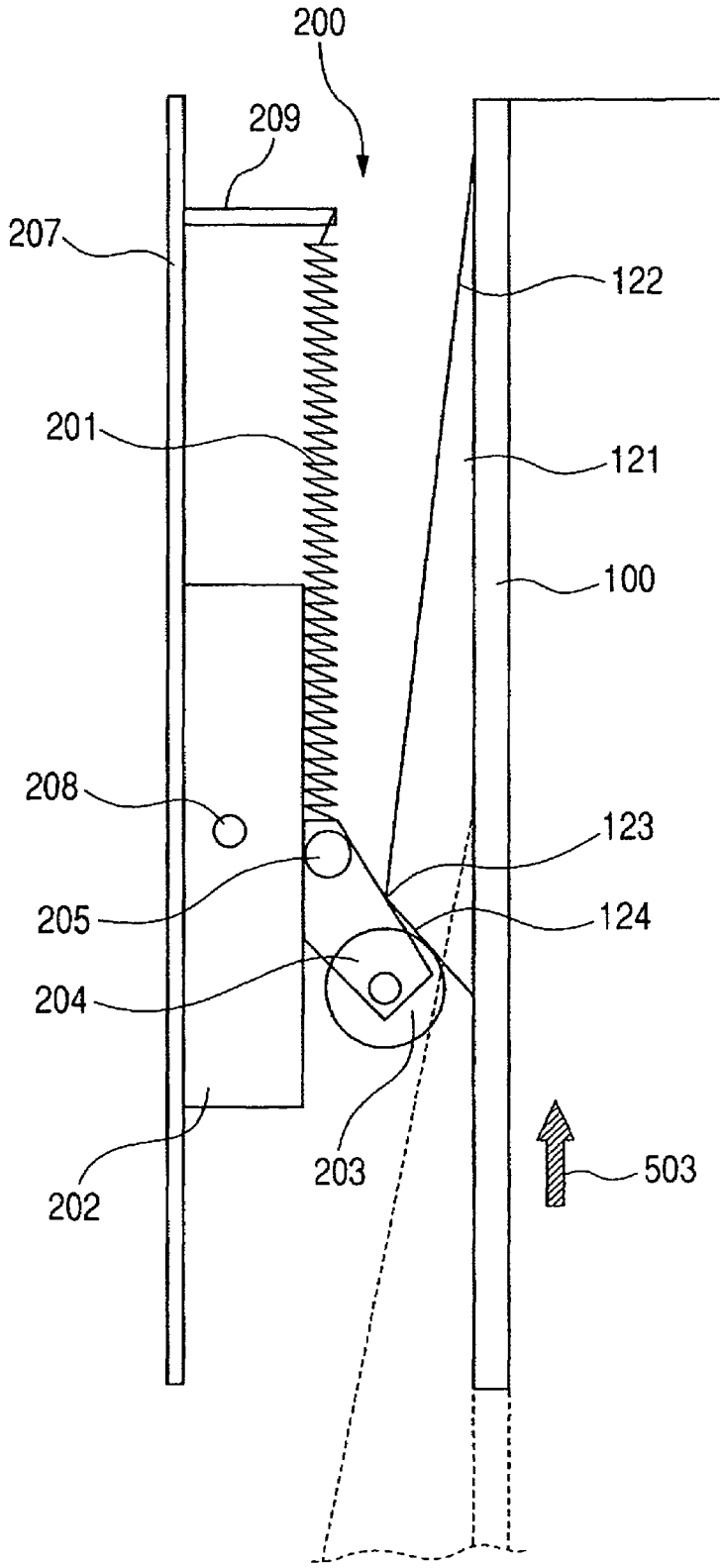
FIG. 8 illustrates the construction of a sheet supplying cassette retracting mechanism provided in the sheet feeding apparatus.

FIG. 8 shows the construction of a cassette retracting mechanism 200 according to the present embodiment. This cassette retracting mechanism 200 is such that when the sheet supplying cassette 100 is inserted, a runner 203 is first urged against the cam distal end portion 122 of a cam 121 by a resilient member 201, and the runner 203 is rotated while frictionally sliding. Also, at this time, an arm 204 is clockwisely pivotally moved in accordance with the shape of the cam 121 while pressing the cam 121 by the resilient member 201 through the runner 203.

Thereafter, the cam 121 and the runner 203 keep their contact state, and when the runner 203 passes the vertex 123 of the cam 121, the runner 203 comes into pressure contact with the rear end portion 124 of the cam 121. As the result, the sheet supplying cassette 100 is pressed in the direction indicated by the arrow 503 which is a direction in which it is retracted to the mounting position in the apparatus main body 1A, by the runner 203 through the cam 121. Thus, the sheet supplying cassette 100 is retracted to the mounting position.

In the present embodiment, maximum retracting pressure 12N is generated immediately after the runner 203 has thus passed the vertex 123 of the cam 121. To generate this maximum retracting pressure 12N, there is adopted an arrangement in which a toggle mechanism can utilize the pivot fulcrum 208 of an arm 204 on a base 202, and the shaft 205 of the arm 204 holding one end of the resilient member 201 and the spring restraining portion 209 of the apparatus main body 207 holding the other end of the resilient member 201.

Now, the present embodiment is constructed such that as already described, on this side of the mounting position, the separating pad 133 contacts with the sheet feeding roller 104, and besides, the retracting direction of the sheet supplying cassette 100 is the same direction as the sheet feeding direction. As the result, as compared with the first embodiment, sliding resistance during the retraction of the sheet supplying cassette 100 (such as the positioning resistance of the sheet supplying cassette 100, and the depression resistance of the sheet size detecting switch) concentratively occurs near the mounting position, e.g. on this side of the mounting position.

Therefore, design is made such that in the vicinity of 10 mm this side from the mounting position of the sheet supplying cassette 100, the cassette retracting mechanism 200 generates maximum retracting pressure, and 10 mm is secured as the retraction stroke amount. That is, in the case of the present embodiment, as compared with the already described first embodiment, the retraction amount becomes small and therefore, the retraction stroke amount also becomes as small as 10 mm, as compared with the first embodiment.

By the retraction amount thus becoming small, the present embodiment is similar to the first embodiment in the construction wherein at the cam vertex 123, the cassette retracting mechanism 200 generates the maximum retracting pressure, but the shape of the cam 121 becomes different from the shape of the cam 101 (see FIG. 4) in the first embodiment. Specifically, the angle formed by the rear end portion 124 of the cam 121 in the present embodiment with respect to the retracting direction of the sheet supplying cassette 100 becomes greater than the angle formed by the rear end portion 114 of the cam 101 in the first embodiment with respect to the retracting direction of the sheet supplying cassette 100.

On the other hand, in a case where as in the present embodiment, the sheet supplying cassette 100 is adapted to be mounted from the direction opposite to the sheet feeding direction, it does not happen that the separating pad 133 frictionally slides in contact with the sheet feeding roller 104 to the vicinity of the mounting position. Therefore, as compared with the already described first embodiment, the sliding resistance when the sheet supplying cassette 100 is contained becomes small, and the sheet supplying cassette 100 can be retracted easily.

Further, if the sliding resistance when the sheet supplying cassette 100 is contained becomes small as described above, it becomes possible to set the resilient member 201 of the cassette retracting mechanism 200 at smaller pressure. As the result, the supply of the sheets S and the taking-out of the sheet supplying cassette 100 during the changing of the sheet size also become easy, and the usability can be improved greatly.

Description will now be made of a third embodiment of the present invention.

Figure 9:
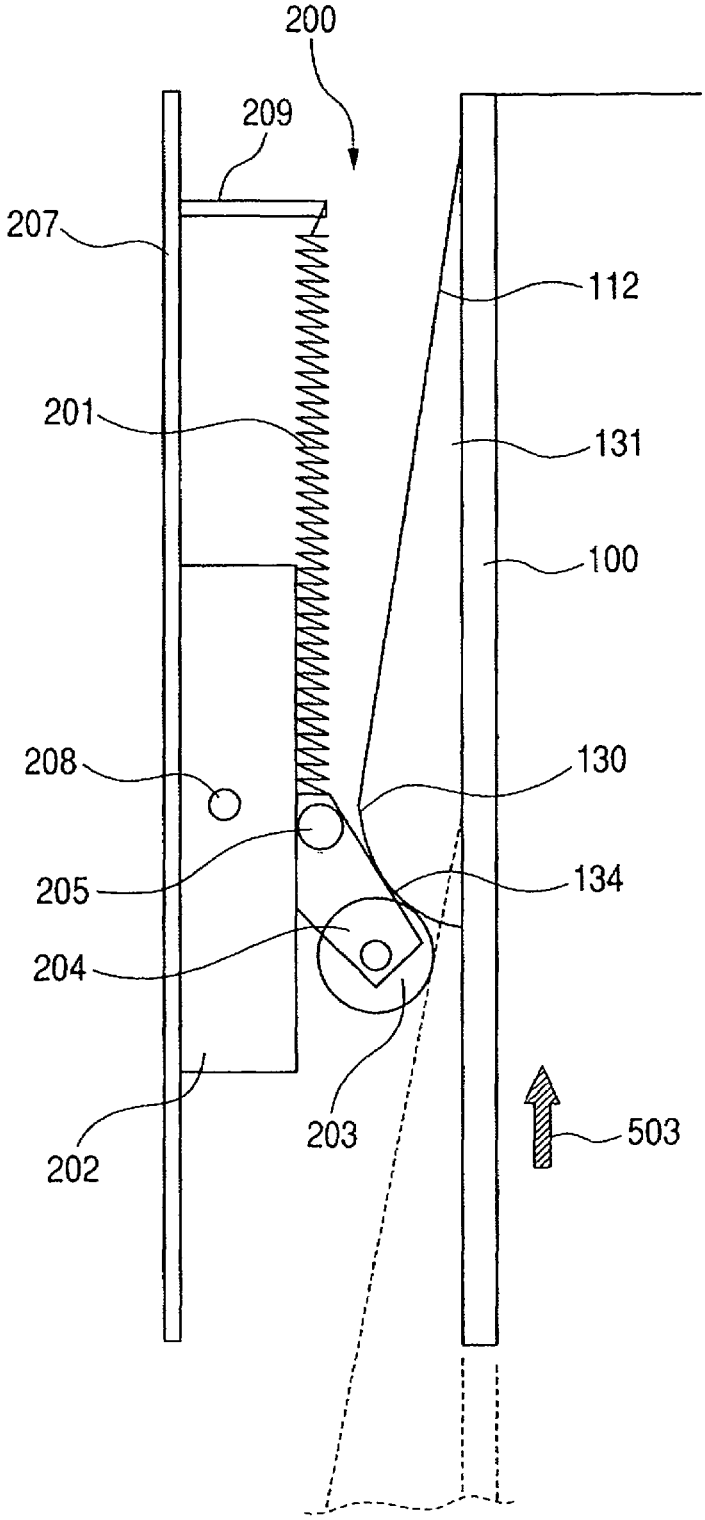
FIG. 9 illustrates the construction of a sheet supplying cassette retracting mechanism provided in a sheet feeding apparatus according to a third embodiment of the present invention.

FIG. 9 shows the construction of a cassette retracting mechanism 200 according to the present embodiment. In the present embodiment, as shown in FIG. 9, the shape of a cam 131 is made such that the cam surface of a rear end portion 134 which is a cam portion with which a runner 203 comes into pressure contact after it has passed a vertex 130 and in which a retracting force is generated is of a curved shape.

In the cassette retracting mechanism 200 according to the present embodiment, when the sheet supplying cassette 100 is inserted, the runner 203 is first urged against the cam distal end portion 112 of a cam 131 by a resilient member 201, and the runner 203 is rotated while frictionally sliding. Also, at this time, an arm 204 is clockwisely pivotally moved in accordance with the shape of the cam 131 while pressing the cam 131 by the resilient member 201 through the runner 203.

Thereafter, the cam 131 and the runner 203 keep their contact state, and when the runner 203 passes the vertex 130 of the cam 131, the runner 203 comes into pressure contact with the rear end portion 134 of the cam 131. As the result, the sheet supplying cassette 100 is pressed in the direction indicated by the arrow 503 which is a direction in which it is retracted to the mounting position in the apparatus main body 1A, by the runner 203 through the cam 131. Thus, the sheet supplying cassette 100 is retracted to the mounting position.

In the present embodiment, maximum retracting pressure 16N is generated immediately after the runner 203 has passed the vertex 134 of the cam 131, as described above. To generate this maximum retracting pressure 16N, there is adopted an arrangement in which a toggle mechanism can utilize the pivot fulcrum 208 of the arm 204 on a base 202, and the shaft 205 of the arm 204 holding one end of the resilient member 201 and the spring restraining portion 209 of the apparatus main body 207 holding the other end of the resilient member.

There is adopted a construction in which this force is utilized to retract the sheet supplying cassette 100. 15 mm is secured as the retraction stroke amount at this time. This retraction stroke amount is the retraction distance (amount) of the sheet supplying cassette 100 by the cassette retracting mechanism 200.

Now, in the present embodiment, the shape of the rear end portion 134 with which the runner 203 comes into pressure contact after it has passed the vertex 130 of the cam 131 is made into a curved shape. That is, the shape of the cam from a position of the rear end portion 134 at which the runner 203 comes into pressure contact and the retracting force is generated until the sheet supplying cassette 100 is retracted to the mounting position is made into a curved shape. Thereby, the cassette retracting pressure decreased after the maximum retracting pressure has been generated at the vertex 130 can be gently decreased.

Further, by the shape of the rear end portion 134 being made into a curved shape, the angle formed between the cassette mounting and dismounting direction and the cam surface can be made great when the sheet supplying cassette 100 has been mounted at the mounting position. Thereby, a strong force can be generated in a cassette holding direction even when the retraction amount is the same.

Thus, the sheet supplying cassette 100 can be reliably held at the mounting position and as the result, the occurrence of a faulty operation and faulty sheet feeding can be prevented, and the usability of the sheet supplying cassette 100 can be greatly improved.

While in the present embodiment, description has been made of a case where the mounting and dismounting direction of the sheet supplying cassette 100 is a direction crossing the sheet feeding direction, as in the second embodiment, the present invention can also be applied to a case where the mounting direction of the sheet supplying cassette 100 and the sheet feeding direction are opposite to each other. Also, the curved shape of the cam surface of the cam 131, if it can be optimally set, may be constituted by any curved surface. Further, while in the foregoing description, a coil spring is used as the resilient member 201, one of other various springs may be used.

This application claims priority from Japanese Patent Application No. 2005-128408 filed on Apr. 26, 2005, which is hereby incorporated by reference herein.

What is claimed is:

1. A sheet feeding apparatus comprising:

a sheet containing member detachably mounted on an apparatus main body;

a sheet feeding member provided in said apparatus main body configured to feed out sheets stacked on said sheet containing member;

a separating member provided in said sheet containing member configured to contact with said sheet feeding member and separating the sheets one by one; and a retracting device provided in said apparatus main body configured to be engaged with said sheet containing member in a way said sheet containing member is being mounted on the apparatus main body, to generate a retracting force for retracting said sheet containing member to a mounting position for feeding the sheets contained therein;

wherein said retracting device has a resilient member, a pivot member biased by said resilient member, and a runner rotatably mounted on said pivot member, wherein the runner is contacted with a cam provided on said sheet containing member, wherein said resilient member gradually accumulates said retracting force therein with the movement of said runner along a shape of said cam when said sheet containing member is mounted in the mounting direction thereof, and wherein immediately after said retracting force accumulated in said resilient member has maximized and said resilient member has released said retracting force, said separating member contacts with said sheet feeding member.

2. A sheet feeding apparatus according to claim 1, wherein the mounting direction of said sheet containing member is a direction crossing a sheet feeding direction by said sheet feeding member.

3. A sheet feeding apparatus according to claim 1, wherein the mounting direction of said sheet containing member is a direction opposite to a sheet feeding direction by said sheet feeding member.

4. A sheet feeding apparatus according to claim 1, wherein said separating member is held on said sheet containing member for movement toward and away from said sheet feeding member, and said separating member is provided with a moving member for moving the separating member to a position for contacting with said sheet feeding member on a way said sheet containing member is being retracted to said mounting position, and moving the separating member to a position spaced apart from said sheet feeding member on a way said sheet containing member is being taken out.

5. A sheet feeding apparatus according to claim 1, wherein said cam is of a curved shape from a position at which said runner comes into pressure contact so as to accumulate said retracting force to a position at which said cam is pressed by said runner with a retracting force of a magnitude which can retract said sheet containing member to the mounting position.

6. A sheet feeding apparatus according to claim 1, wherein said force accumulating member accumulates therein a pushing-out force for gradually pushing out said sheet containing member with a movement of said sheet containing member in a taking-out direction thereof when said sheet containing member is taken out from said mounting position, and protrudes said sheet containing member from the apparatus main body by the liberation of said pushing-out force when said pushing-out force has become maximum.

7. An image forming apparatus comprising:

a sheet containing member detachably mounted on an apparatus main body;

a sheet feeding member provided in said apparatus main body configured to feed out sheets stacked on said sheet containing member;

a separating member provided in said sheet containing member configured to contact with said sheet feeding member and separating the sheets one by one;

a retracting device provided in said apparatus main body configured to be engaged with said sheet containing member in a way said sheet containing member is being mounted on the apparatus main body, to generate a retracting force for retracting said sheet containing member to a mounting position for feeding the sheets contained therein; and an image forming portion for forming an image on a sheet fed out from said sheet containing member, wherein said retracting device has a resilient member, a pivot member biased by said resilient member, and a runner rotatably mounted on said pivot member, wherein the runner is contacted with a cam provided on said sheet containing member, wherein said resilient member gradually accumulates said retracting force therein with the movement of said runner along a shape of said cam when said sheet containing member is mounted in the mounting direction thereof, and wherein immediately after said retracting force accumulated in said resilient member has maximized and said resilient member has released said retracting force, said separating member contacts with said sheet feeding member.

8. An image forming apparatus according to claim 7, wherein the mounting direction of said sheet containing member is a direction crossing a sheet feeding direction by said sheet feeding member.

9. An image forming apparatus according to claim 7, wherein the mounting direction of said sheet containing member is a direction opposite to a sheet feeding direction by said sheet feeding member.

10. An image forming apparatus according to claim 7, wherein said separating member is held on said sheet containing member for movement toward and away from said sheet feeding member, and said separating member is provided with a moving member for moving the separating member to a position for contacting with said sheet feeding member while said sheet containing member is being retracted to said mounting position, and moving the separating member to a position spaced apart from said sheet feeding member while said sheet containing member is being taken out.

11. An image forming apparatus according to claim 7, wherein said cam is of a curved shape from a position at which said runner comes into pressure contact so as to accumulate said retracting force to a position at which said cam is pressed by said runner with a retracting force of a magnitude which can retract said sheet containing member to the mounting position.

12. An image forming apparatus according to claim 7, wherein said force accumulating member accumulates therein a pushing-out force for gradually pushing out said sheet containing member with a movement of said sheet containing member in a taking-out direction thereof when said sheet containing member is taken out from said mounting position, and protrudes said sheet containing member from the apparatus main body by the liberation of said pushing-out force when said pushing-out force has become maximum.

* * * * *